US008016116B2

(12) United States Patent
Schneider

(10) Patent No.: US 8,016,116 B2
(45) Date of Patent: Sep. 13, 2011

(54) WASH DOWN DEDUSTING APPARATUS

(75) Inventor: Heinz Schneider, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 286 days.

(21) Appl. No.: 12/327,792

(22) Filed: Dec. 3, 2008

(65) Prior Publication Data

US 2009/0145815 A1 Jun. 11, 2009

Related U.S. Application Data

(60) Provisional application No. 60/992,666, filed on Dec. 5, 2007.

(51) Int. Cl.
*G07N 4/00* (2006.01)
*B07B 7/00* (2006.01)

(52) U.S. Cl. ..... 209/139.1; 209/133; 209/136; 209/137; 209/138

(58) Field of Classification Search ..... 209/133, 209/136, 137, 138, 139.1
See application file for complete search history.

(56) References Cited

U.S. PATENT DOCUMENTS

| | | | | |
|---|---|---|---|---|
| 4,568,453 | A * | 2/1986 | Lowe, Jr. | 209/135 |
| 5,035,331 | A * | 7/1991 | Paulson | 209/3 |
| 5,259,510 | A * | 11/1993 | Lowe et al. | 209/134 |
| 6,595,369 | B2 * | 7/2003 | Paulson | 209/149 |
| 7,380,670 | B2 * | 6/2008 | Paulson et al. | 209/39 |
| 2004/0194622 | A1 * | 10/2004 | Kiss | 95/211 |
| 2007/0272598 | A1 * | 11/2007 | Schneider et al. | 209/12.1 |

* cited by examiner

*Primary Examiner* — Stefanos Karmis
*Assistant Examiner* — Michael E. Butler
(74) *Attorney, Agent, or Firm* — Miller Law Group, PLLC

(57) ABSTRACT

An open configuration is provided for the housing of a particulate material dedusting apparatus through which particulate material passes to be cleaned by air passing through wash decks to separate dirt and debris from the particulate material for discharge from the housing. The front wall and side access doors of the housing are configured to be openable for full access to the front and rear chambers. The primary wash deck is detachably mounted within the housing for removal for cleaning purposes. The generally horizontal floors of the housing are formed with a slope to allow water to drain from the housing. The open configuration of the deduster housing facilitates cleaning, draining and drying of the housing to expedite changeover from one material to another. Furthermore, the open configuration allows access for improved welding to eliminate cracks and openings in joints which accumulate dirt and debris during operation.

19 Claims, 6 Drawing Sheets

Fig. 5
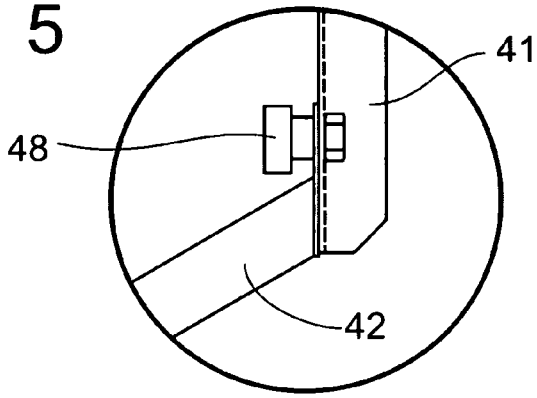
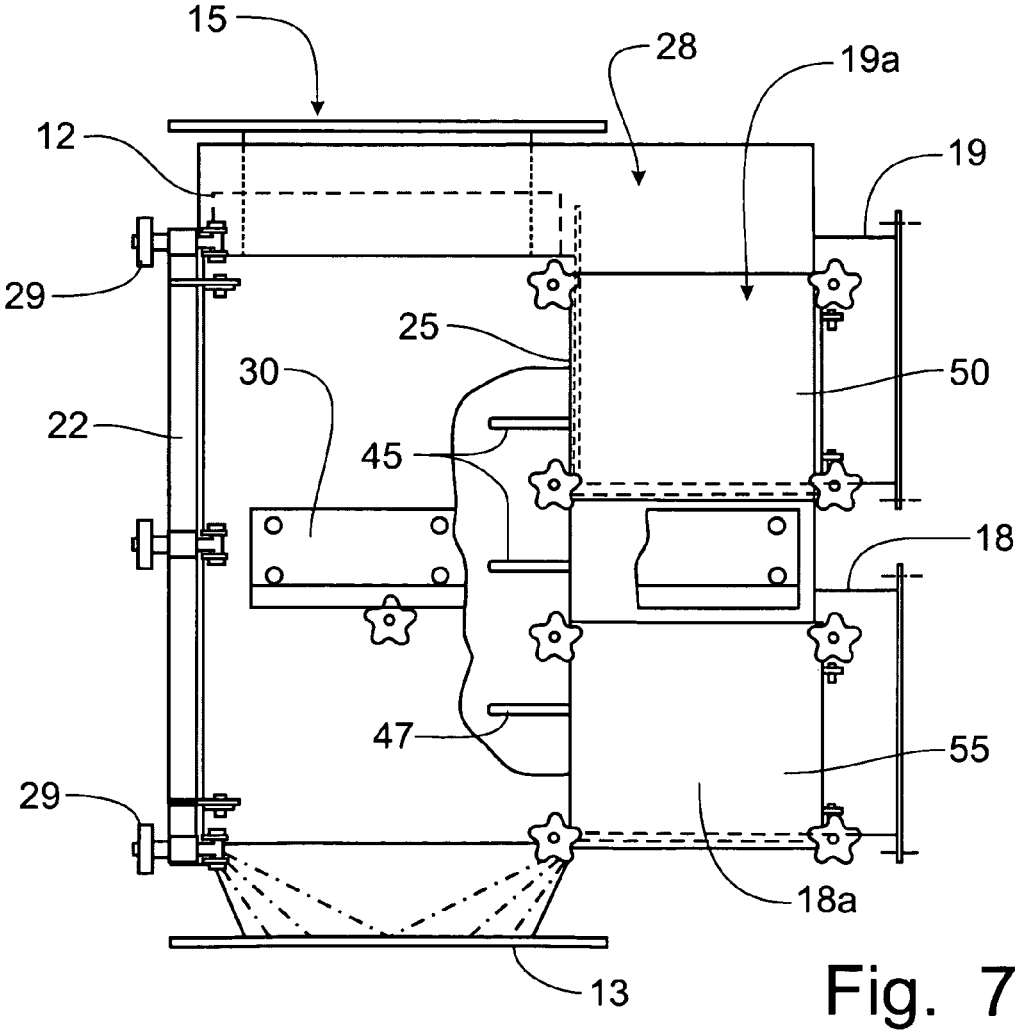
Fig. 7

WASH DOWN DEDUSTING APPARATUS

CROSS-REFERENCE TO RELATED APPLICATIONS

This application claims domestic priority on U.S. Provisional Patent Application Ser. No. 60/992,666, filed Dec. 5, 2007, and entitled "Wash Down Dedusting Apparatus", the contents of which are incorporated herein by reference.

FIELD OF THE INVENTION

The invention disclosed in this application is directed generally to the cleaning and handling of particulate materials, such as plastic pellets, grains, glass, and the like, and particularly to the cleaning of the dedusting apparatus following a specific use of the apparatus to ready the dedusting apparatus for use with a different particulate material.

BACKGROUND OF THE INVENTION

It is well known, particularly in the field of transporting and using particulate materials, commonly powders, granules, pellets, and the like that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, and streamers (ribbon-like elements that can "grow" into quite long and tangled wads that will impede the flow of materials or even totally block the flow). The characteristics of such a transport system are quite well known, as is the importance and value of keeping product particles as free as possible of contaminants.

The term "contaminant" as used herein includes a broad range of foreign material as well as the broken particles, dust, fluff and streamers mentioned in the preceding paragraph. In any case, contaminants are detrimental to the production of a high quality product, and in some situations a health risk to employees of the producer and possibly even a source of danger in that some contaminants can produce a dust cloud which, if exposed to an ignition source, may explode.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Once a specific particulate material has been passed through the dedusting apparatus and a different particulate material is desired to be cleaned through the operation of the dedusting apparatus, the dedusting apparatus needs to be cleaned. Conventional dedusting devices are constructed with horizontal planar surfaces and incomplete welds at the joints and corners due to an inability to get welding equipment properly positioned to form perfect welds. Furthermore, these cracks and corners, along with the horizontal planar surfaces create pockets where particulate material can accumulate and become difficult to remove from the dedusting apparatus. Removal of this accumulated material, whether the accumulated material is dirt or particulate material is important in cleaning the dedusting apparatus for subsequent use as the old particulate material is a contaminate as much as dirt and debris to the new particulate material to be cleaned.

Accordingly, it would be desirable to provide a dedusting apparatus that can be easily cleaned, particularly to be cleaned by spray washing techniques, such that the water is easily drained from the apparatus and such that all the accumulated dirt, debris and remaining particulate material can be removed from the apparatus.

SUMMARY OF THE INVENTION

It is an object of this invention to overcome the disadvantages of the prior art by providing a dedusting apparatus that is configured to facilitate cleaning by spraying water into the housing.

It is another object of this invention to provide a deduster housing that can be opened to allow cleanout by water sprays.

It is a feature of this invention that the floor surfaces of the deduster housing are sloped to drain water from the housing.

It is another feature of this invention that the front wall of the housing can be pivotally opened, or in the alternative completely removed from the housing, to expose the interior of the deduster front chamber for cleaning.

It is still another feature of this invention that the primary wash deck can be completely removed from the housing.

It is an advantage of this invention that the removal of the primary wash deck exposes the front chamber of the deduster housing for spray cleaning.

It is yet another feature of this invention that the side access doors of the deduster housing can be opened to expose the rear chamber for cleaning.

It is another advantage of this invention that the opening of the side access doors and the front door opens the deduster housing for hand drying after being washed down.

It is still another advantage of this invention that the opening of the side access doors enhances the ability to weld the corners and joints between the floors within the housing, the air openings and the respective vertical walls of the housing.

It is yet another advantage of this invention that the improved welding access to the interior of the deduster allows openings and cracks to be eliminated which catch and accumulate dirt and debris during operation.

It is still another object of this invention to provide a deduster housing that has an open configuration to allow for a closed, welded construction that facilitates cleaning of the deduster after utilization, and to expedite a switch from one product to another to pass through the deduster for cleaning.

It is a further advantage of this invention that no portion of the deduster is inaccessible for cleaning, draining and drying.

It is yet another object of this invention to provide a housing for a particulate material deduster that has an open configuration to expedite cleaning thereof and which is durable in construction, inexpensive to manufacture, carefree of maintenance, facile in assemblage, and simple and effective in use.

These and other objects, features and advantages are accomplished according to the instant invention by providing an open configuration for the housing of a particulate material dedusting apparatus through which particulate material passes to be cleaned while passing over wash decks by air passing through the wash decks to separate dirt and debris from the particulate material for discharge from the housing. The front wall and side access doors of the housing are configured to be openable for full access to the front and rear chambers. The primary wash deck is detachably mounted within the housing for removal for cleaning purposes. The generally horizontal floors of the housing are formed with a slope to allow water to drain from the housing. The open configuration of the deduster housing facilitates cleaning, draining and drying of the housing to expedite changeover from one material to another. Furthermore, the open configuration allows access for improved welding to eliminate cracks and openings in joints which accumulate dirt and debris during operation.

BRIEF DESCRIPTION OF THE DRAWINGS

The advantages of this invention will become apparent upon consideration of the following detailed disclosure of the invention, especially when taken in conjunction with the accompanying drawings wherein:

FIG. 5 is an enlarged detail view of the connection between the upper and lower segments of the central wash decks corresponding to the circle 5 of FIG. 1;

FIG. 7 is a side elevational view similar to that of FIG. 2, but having a portion of the bypass box broken away to show the guide pins for mounting the upper and lower segments of the primary wash deck apparatus, which has been removed for purposes of clarity.

DETAILED DESCRIPTION OF THE PREFERRED EMBODIMENT

Figure 1:
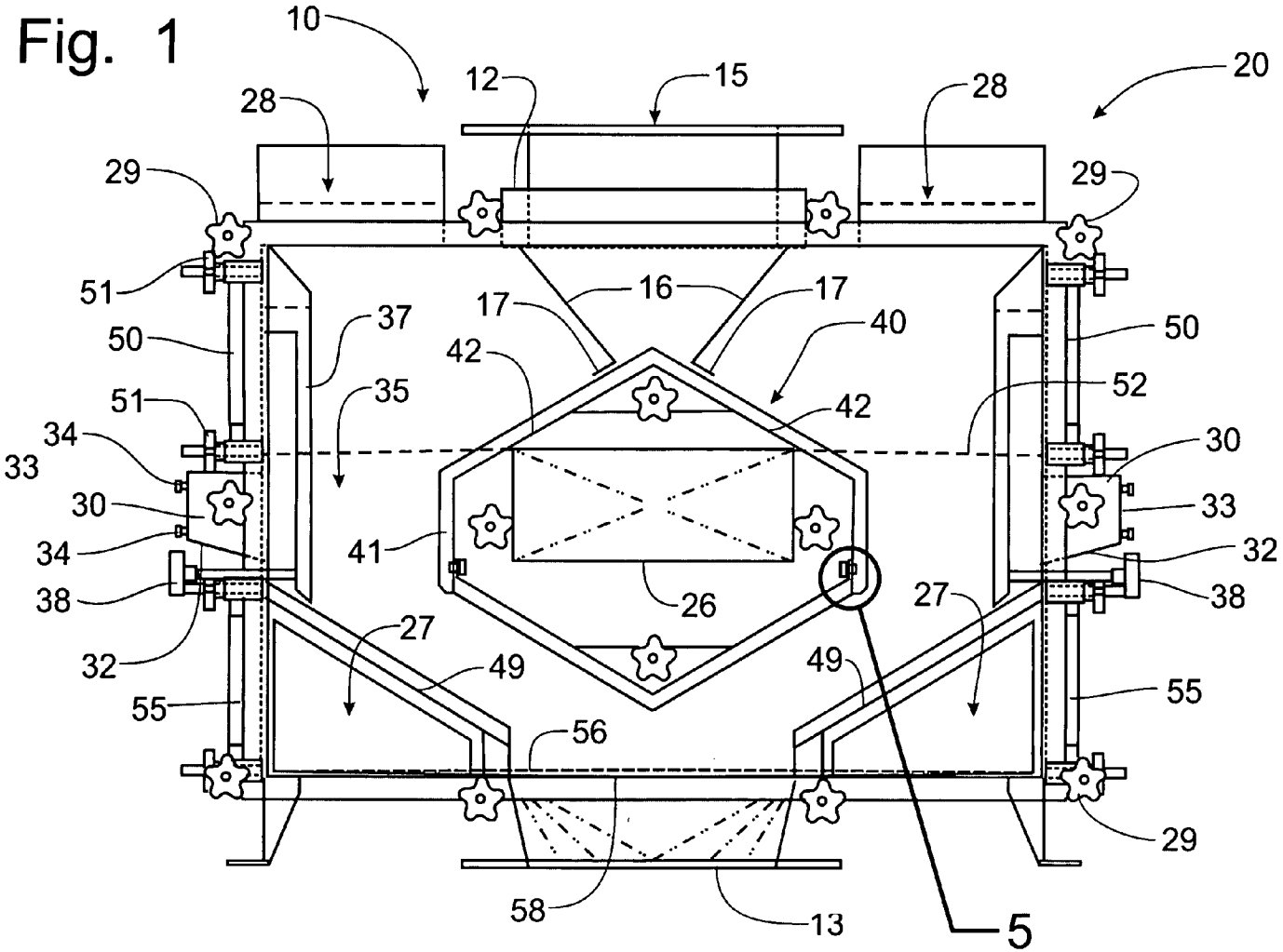
FIG. 1 is a front elevational view of a compact dedusting apparatus incorporating the principles of the instant invention.
Figure 2:
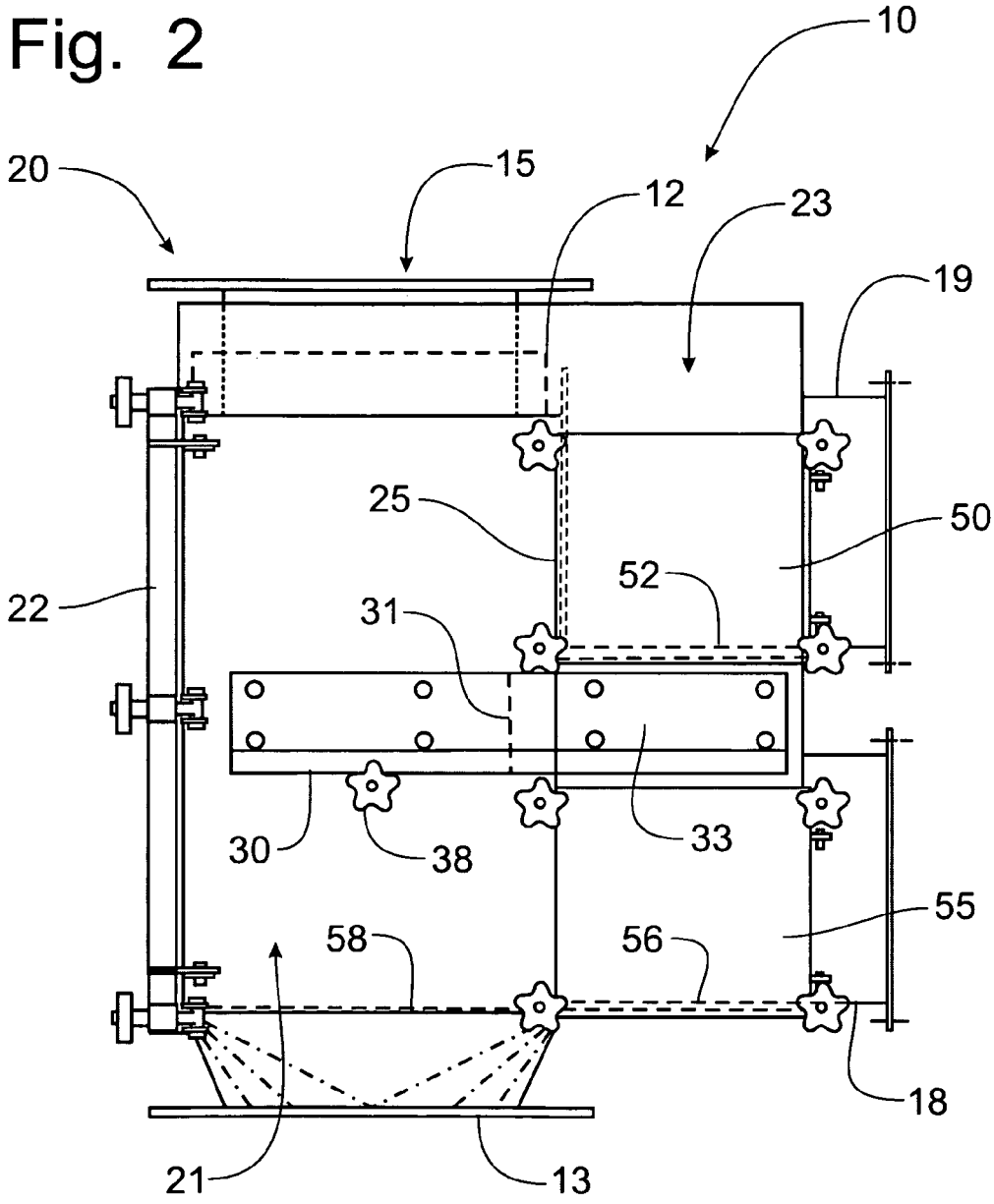
FIG. 2 is a left side elevational view of the dedusting apparatus shown in FIG. 1.
Figure 3:
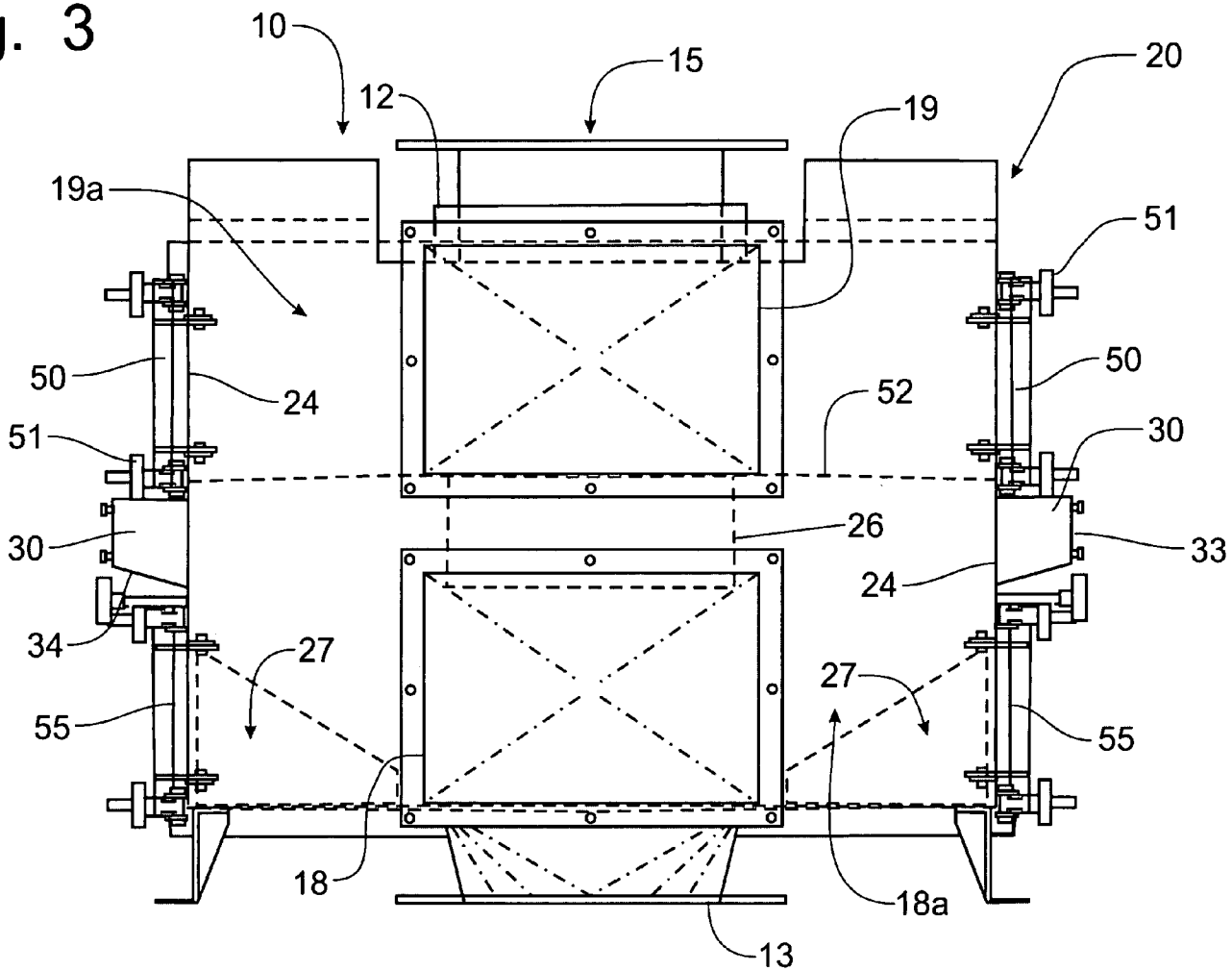
FIG. 3 is a rear elevational view of the dedusting apparatus shown in FIG. 1.
Figure 4:
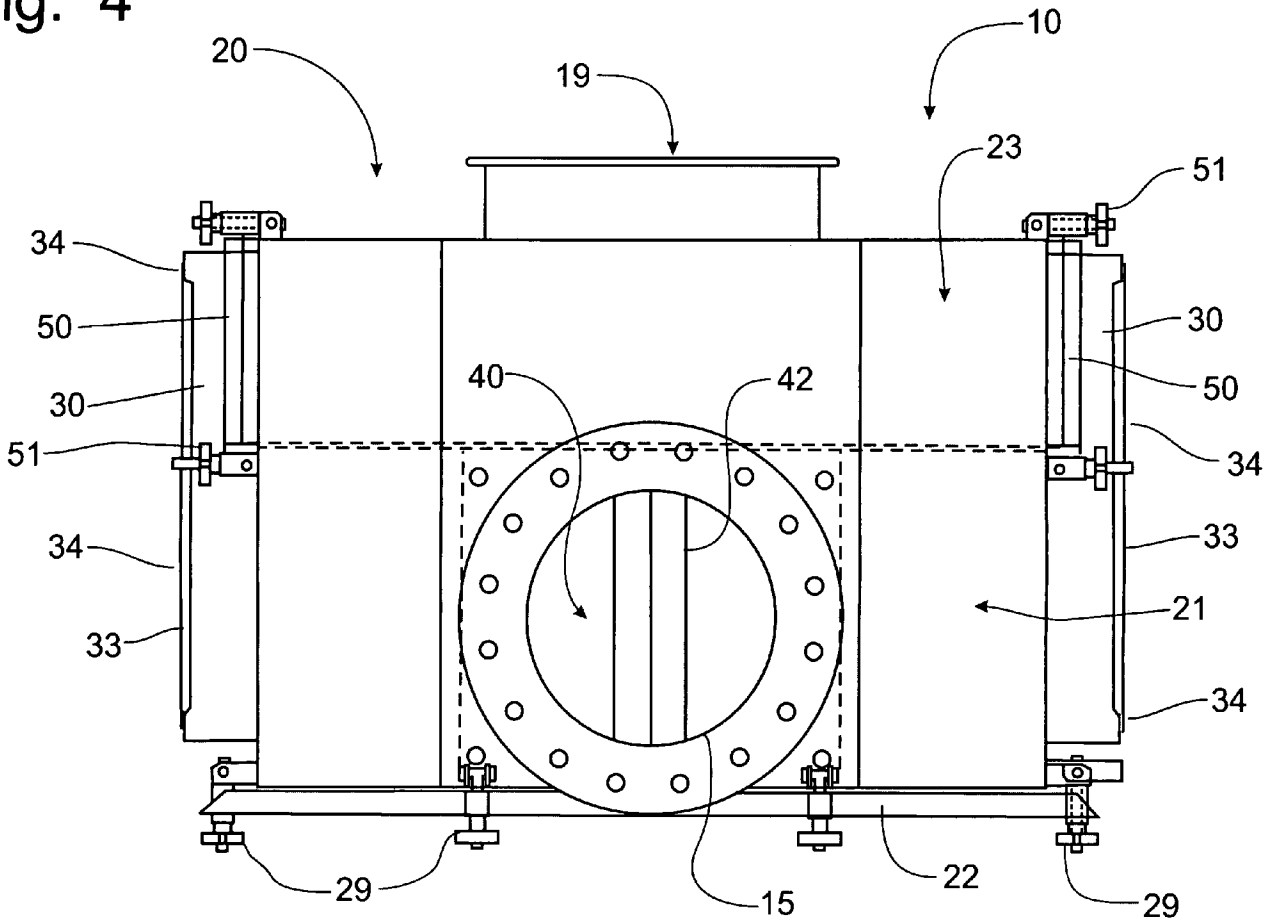
FIG. 4 is a top plan view of the dedusting apparatus shown in FIG. 1.

Referring to FIGS. 1-4, the dedusting apparatus 10 is typically associated with an injection molding machine that has a feed hopper at the input into which is fed a controlled amount of raw material in the form of plastic pellets. The molding machine may be of any form or type, and is not part of the instant invention. The dedusting apparatus is typically affixed to the hopper in a manner that the plastic pellets must pass through the dedusting apparatus on the way to the hopper. For purposes of explanation, particulate product (in this example, plastic pellets plus the usual contaminants associated therewith) is fed into the dedusting apparatus 10 at the inlet 15 where the particulate material enters a flux field generated by the primary magnetic flux field generator 12. As more fully explained in earlier U.S. Pat. No. 5,035,331, issued on Jul. 19, 1991, which is incorporated herein in its entirety by reference, this magnetic flux field disrupts the electrostatic bond between dust and pellets to permit the dedusting apparatus 10 to separate the dust from the pellets.

The particulate product flows through the infeed mechanism 15, which could be of the type shown and described in co-pending U.S. patent application Ser. No. 11/762,906, filed on Jun. 14, 2007, and entitled "Infeed Device for Deduster Apparatus", which drops the particulate pellets in a measured, consistent flow onto a central, primary wash deck apparatus 40 where the particulate material is fluidized by wash air that lifts the lighter contaminants above the main product stream. The infeed mechanism 15 would preferably include a pair of opposing restrictor plates 16 to direct the particulate pellets into a narrowed opening at the top of the wash deck apparatus 40. The restrictor plates 16 preferably have a metering vane 17 at the lower end thereof to extend along the surface of the wash deck apparatus 40 to meter the particulate pellets into a uniform flow along the wash deck apparatus 40 and to prevent the bouncing of the particulate pellets upwardly from the wash deck apparatus 40.

The particulate material then passes through a venturi chamber 35 that regulates updraft air velocity, via an air knife, as will be described in greater detail below, to a sufficient level to remove even difficult contaminants. The dust, fluff and streamers are carried out of the dedusting apparatus 10 through air outlet 19. The air is filtered at the air inlet 18 and either recirculated to the wash decks 42, 49 through a dust collector (not shown), or discharged to the atmosphere. The cleaned pellets are then discharged through product outlet 14 at the base of the dedusting unit 10 and into the utilization process, in this example, a plastic molding machine.

The magnetic flux field serves to disrupt the static charge attraction of dust and other contaminants adhering to the primary particulate product, thereby allowing this unwanted material to be separated more easily and removed from the product flow path. The magnetic field is varied in strength and frequency to vary the level and intensity of the flux field in order to more effectively cause separation of the contaminants and the primary product. Primary separation is achieved by airflow through the product by means of a primary wash deck 40 to both remove the unwanted material from the flow path and to accelerate the primary product along that path. A venturi zone 35 creates high relative velocity counter-airflow to more effectively promote separation of the contaminants. Secondary cleaning and magnetic fields can also be provided. The discharged air is treated to trap the removed contaminants, preventing it from returning into the flow path. The subject apparatus preferably has a slight negative internal pressure to assure collection of the separated contaminants.

The magnetic flux generator 12 is not necessary in every application. If the dust particles to be removed are less than 100 microns in diameter, the magnetic flux generator 12 should be used; however, for removal of dust particles greater than 100 microns in diameter, a magnetic flux generator 12 may not be necessary or essential.

The housing 20 is generally divided into a front chamber 21 and a rear chamber 23, which in turn is vertically divided between the lower inlet area 18*a* and the upper outlet area 19*a*. Between the front and rear chamber is a vertical wall 25 that has a central main opening 26 for the passage of clean air into the front chamber 21 and two laterally spaced, generally triangular openings 27 for the passage of clean air into the front chamber 21, as will be described in greater detail below. In addition, each of the lateral sides of the housing 20 are formed with a bypass box 30 that have a central baffle 31 that is positionable within the bypass box 30 to adjust the amount of air moving from the rear chamber 23 to the front chamber 21 directly into the venturi zones 35 on the corresponding sides of the housing 20.

Clean air moving from the rear chamber 23 through the central opening 26 passes into the primary wash deck apparatus 40 which is formed by a pair of opposing upwardly angled primary wash decks 42 that meet at an apex located immediately below the infeed mechanism 15 where the particulate product to be cleaned is directed for equal distribution down both primary wash decks 42. The primary wash deck apparatus 40 is divided into an upper segment 41 that encompasses the two primary wash decks 42 and a lower segment that forms a generally diamond-shaped configuration that extends between the central vertical wall 25 and the front wall 22 of the housing 20 to trap the clean air so that the clean air is forced upwardly through the slots and openings formed within the two primary wash decks 42 to create a fluidized particulate flow over the primary wash decks 42.

Figure 6:
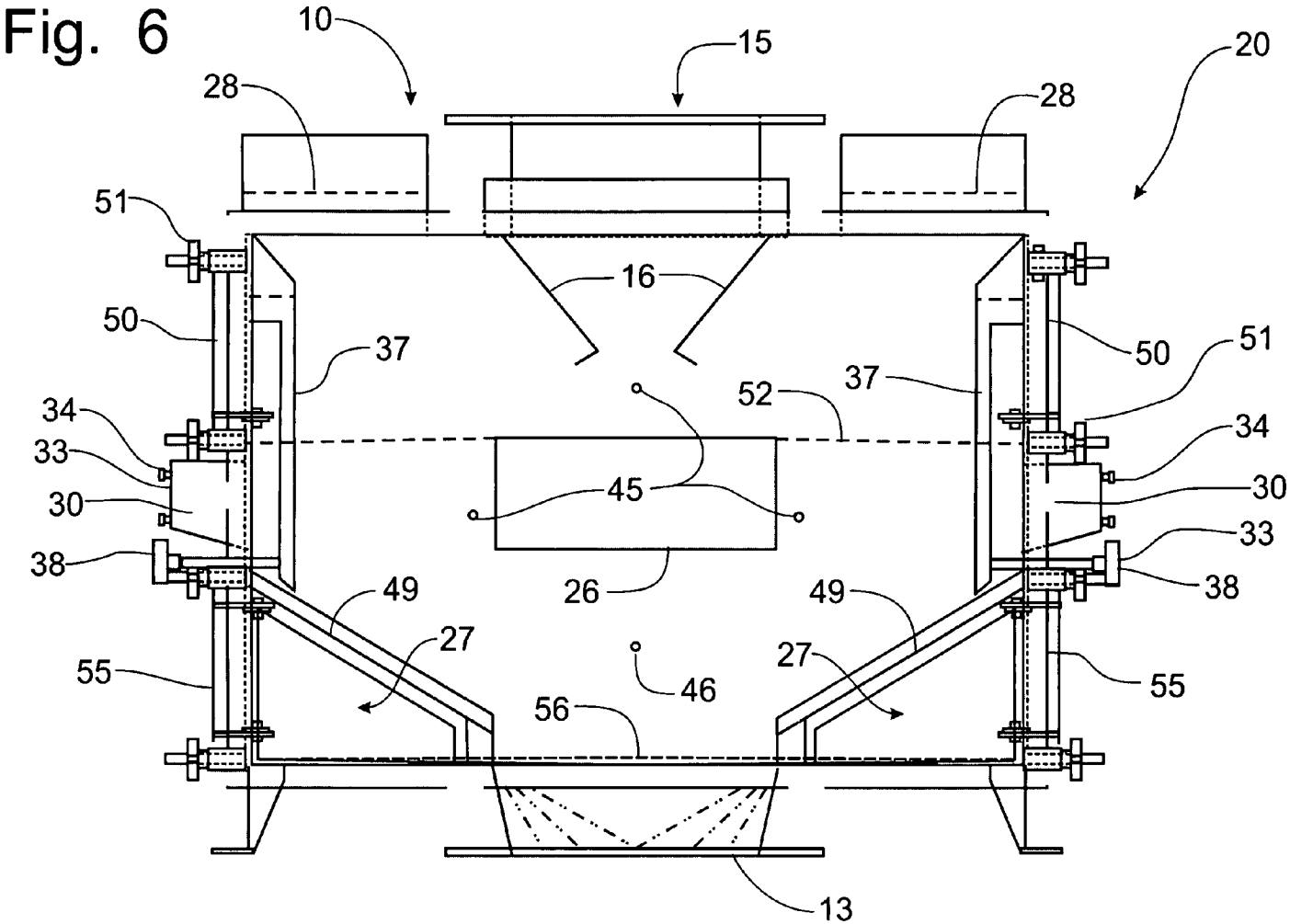
FIG. 6 is a front elevational view of the dedusting apparatus similar to that of FIG. 1, but with the front wall removed and the primary wash deck apparatus removed from the central wall.

As is best seen in FIGS. 1, and 5-7, the lower segment 43 is detachably connected to the upper segment 41 so as to be separable therefrom. Thumb nuts 48 are manually manipulative to permit the lower segment 43 to be removed from the upper segment 41, while threaded hand knobs 44 connect the upper and lower segments 41, 43 to the central wall 25. To remove the primary wash deck apparatus 40 from the housing 20, the front wall 22, which is detachably connected via hand knobs 29 to the side walls 24 of the housing 20, is removed to permit access to the primary wash deck apparatus 40. The thumb nuts 48 are removed and the appropriate hand knobs 44 are loosened so that the lower segment 43 can be pulled forwardly off the guide pin 46. The upper segment 41 can then be removed by loosening the hand knobs 44 and pulling the upper segment 41 forwardly off its guide pin 45. Thus, the entire primary wash deck apparatus 40 can be removed from the housing 20 for detailed cleaning as needed.

Returning to FIGS. 1-4, after the particulate material has passed off the primary wash decks 42, the particulate material enters into the venturi zones 35 between the lateral sides of the primary wash deck apparatus 40 and the positionally adjustable vertical baffle 37. Air passing upwardly from the triangular openings 27, after passing through the secondary wash decks 49, as will be described in greater detail below, move to the air outlet 19 by passing through the venturi zones 35. Furthermore, air being directed through the bypass boxes 30 will pass beneath the vertical baffles 37 and upwardly through the venturi zones 35 to form an air knife that passes through the particulate material as the material falls off the primary wash decks 42 onto the secondary wash decks 49. With the amount of air passing through the bypass boxes 30 being adjustable through manipulation of the central baffle 31 the operation of the air knife in the venturi zones 35 can be selectively manipulated. The positional adjustment of the vertical baffles 37 is accomplished through the threaded knobs 38 mounted in the side walls 24 to move the vertical baffles 37 inwardly or outwardly relative to the primary wash deck apparatus 40.

The particulate material falls off the primary wash decks 42 through the venturi zones 35 and onto the secondary wash decks 49 where clean air flowing from the air inlet 18 through the triangular openings 27 passes upwardly through the slots and openings formed in the secondary wash decks 49 to provide a fluidized flow over the secondary wash decks 49, as is described above with respect to the primary wash decks 42. The air, which carries the dirt and debris removed from the particulate material flow passes upwardly from the secondary wash decks 49 through the venturi zones 35 and joins the air from the central opening 26 that moves through the primary wash decks 42 to exit from the front chamber 21 through exit openings 28 at the top of the front chamber 21 and then downwardly into the upper outlet area 19*a* in the rear chamber 23 for discharge from the dedusting apparatus 10 through the air outlet 19. The cleaned particulate material discharges off the secondary wash decks 49 into the product outlet 13 for removal to the machinery (not shown) that will utilize the cleaned particulate material.

To facilitate the cleaning of the rear chamber 23, the opposing side walls 24 of the housing along the upper area 19*a* corresponding to the air outlet 19 are formed with access doors 50 that are selectively opened through the loosening of the hand knobs 51. The generally horizontal floor 52 of the air outlet area 19*a* is sloped downwardly and outwardly from the air outlet opening 19 to direct water from the central air outlet opening 19 toward the side walls 24 for discharge through the opened access doors 50. Furthermore, the air outlet opening 19 is sloped slightly so that water at the outlet opening 19 will drain into the floor 52 and then outwardly toward one of the access doors 50.

Similarly, the floor 56 of the lower air inlet area 18*a* is sloped downwardly and outwardly from the air inlet opening 18 toward the outer side walls 24 of the housing 20. Optionally, the side walls 24 can each have a lower access door 55 to permit access to the air inlet area 18*a*; however, the floor 56 in the rear chamber 23 corresponding to the lower air inlet opening 18*a* is sloped downwardly and outwardly where the triangular openings 27 are located, thus allowing water to flow through the triangular openings 27 into the front chamber 21. The floor 58 of the front chamber 21 is oppositely sloped downwardly and inwardly toward the product outlet 13. Accordingly, water used to clean the interior of the housing 20 can flow from the air inlet area 18*a* through the triangular openings 27 on either side of the housing 20 for movement inwardly underneath the secondary wash decks 49 into the product outlet opening 13 for discharge from the housing 20.

The preferred structure shown in the drawings include a central portion on both of the floors 52, 56 in the rear chamber 23 that correspond to the air outlet opening 19 and the air inlet opening 18, respectively. The outboard lateral portions of the floor members 52, 56 are then sloped downwardly and outwardly toward the corresponding opposing side walls 24. One skilled in the art will recognize that this depicted structure is not the only configuration that will provide a drainage path from the air inlet and outlet openings 18, 19 toward the respective side walls 24. These floor members 52, 56 for the upper and lower areas 19*a*, 18*a* could also be simply crowned at the center where the air openings 18, 19 are located and sloped outwardly therefrom.

The bypass boxes 30 are also created to facilitate cleanout. The bypass boxes are substantially smaller than is known previously and are formed with an inwardly and downwardly sloped floor 32 that will drain water from the bypass boxes 30 into the front chamber 21 over top of or through the secondary wash decks 49 or into the lower air inlet area 18*a* and ultimately through the triangular openings 27 for discharge down the product outlet opening 13. The bypass boxes 30 are also formed with a removable outside wall 33 to provide access into the interior of the bypass boxes 30. The removable wall 33 is attached by thumb screws 34 which can be manually manipulated to allow the removal of the wall 33.

Accordingly, the entire housing 20 is designed to facilitate wash down via water sprays, such as an automated water spray apparatus (not shown), so that the water, accumulated dirt and debris and the remaining particulate material will be easily removed from the housing 20. The primary wash deck apparatus 40 is completely removable from the housing 20 while the complete interior of the housing is manufactured in a manner that will present a structure that can be easily cleaned and have the water sprayed inside the housing drain completely from inside the housing 20. Furthermore, with the front wall 22 being pivotally openable, as depicted in the drawings, or in the alternative being completely removable from the housing 20, to expose the entire front chamber 21, and with the side access doors 50, 55 permitting full access to the rear chamber 23, the housing 20 can be opened for hand drying after being washed down. Conventionally, the dedusting apparatus 10 would be disconnected from any processing machinery and moved to a remote location for a complete wash down between operations. As can be seen above, no portion of the interior of the housing 20 is inaccessible for cleaning, draining and drying.

Furthermore, the provision of the access doors 50, 55 will enable an improved access to the interior of the housing 20 for improved welding at the corners and joints between the floors 52, 55, the air openings 18, 19 and the respective vertical walls of the housing 20 to eliminate any openings or cracks that can accumulate dirt and debris. Thus, the entire housing 20 can be formed in a closed, welded construction that eliminates any crack or opening in which dirt, debris and particulate material can be trapped and accumulate within the housing without being successfully washed from the housing 20.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A dedusting apparatus for cleaning dirt and debris from particulate material, comprising:

a housing having laterally spaced side walls, longitudinally spaced front and rear walls and vertically spaced top and bottom walls, said housing being divided into a front chamber and a rear chamber with a generally vertical transverse central wall therebetween extending between said side walls and between said top and bottom walls, said central wall being formed with a main opening therein, said rear chamber being divided into an upper area and a lower area, said upper area including a first generally horizontal floor extending between said central wall and said rear wall and separating said upper and lower areas;

a product infeed located at an upper portion of said front chamber for the introduction of particulate material to be cleaned into said front chamber;

a product outlet opening located in a lower portion of said front chamber for the discharge of particulate material from said housing;

an air inlet in said lower area of said rear chamber and being in flow communication with said main opening to direct a flow of air into said front chamber;

an air outlet in said upper area of said rear chamber and being in flow communication with said front chamber via exit openings located at an upper portion of said front chamber; and a primary wash deck apparatus mounted between said front wall and said central wall to be in flow communication with said main opening so that air from said air inlet will flow upwardly through said wash deck apparatus to separate said dirt and debris from said particulate material received on said wash deck apparatus from said product infeed, said primary wash deck apparatus being detachably mounted to said central wall.

2. The dedusting apparatus of claim 1 wherein said primary wash deck apparatus is detachably connected to said central wall by hand manipulated fasteners to facilitate removal thereof from said central wall.

3. The dedusting apparatus of claim 2 wherein said central wall is formed with guide members for aligning said primary wash deck apparatus when being mounted onto said central wall.

4. The dedusting apparatus of claim 3 wherein said primary wash deck apparatus includes an upper segment having a wash deck formed thereon, and a lower segment detachable from said upper segment.

5. The dedusting apparatus of claim 1 wherein said front wall is movable to expose said front chamber for cleaning.

6. The dedusting apparatus of claim 5 wherein said housing further includes side walls spanning said front and rear chambers, said first floor being sloped downwardly and outwardly to provide a drainage path from said air outlet opening to the respective said wall.

7. The dedusting apparatus of claim 6 wherein each said side wall includes an upper access door corresponding to said upper area of said rear chamber, said first floor being laterally sloped to drain toward the corresponding said upper access door.

8. The dedusting apparatus of claim 7 wherein said central wall is formed with a pair of laterally spaced secondary openings located at a lower portion of said central wall, said lower area of said rear chamber having a second floor, said second floor member having lateral outward portions being sloped downwardly and outwardly toward the respective said secondary openings to provide a drainage path from said air inlet opening to said secondary openings.

9. The dedusting apparatus of claim 8 wherein and said front chamber has a third floor sloped downwardly and inwardly toward said product outlet opening to continue said drainage path from said air inlet opening through said secondary openings to said product outlet opening.

10. A dedusting apparatus for cleaning dirt and debris from particulate material, comprising:

a housing divided into a front chamber and a rear chamber with a generally vertical transverse central wall therebetween, said central wall being formed with a main opening and a pair of laterally spaced secondary openings located at a lower portion of said central wall, said housing including side walls spanning said front and rear chambers, said rear chamber being divided into an upper area and a lower area, said upper area including a first floor member separating said upper and lower areas, said lower area including a second floor member and said front chamber including a third floor member, said front chamber having a generally vertical front wall;

an air inlet in said lower area of said rear chamber and being in flow communication with said main opening to direct a flow of air into said front chamber, said second floor member having lateral outward portions being sloped downwardly and outwardly toward respective said secondary openings to provide a drainage path from said air inlet opening to said secondary openings, said third floor member being sloped downwardly and inwardly toward a vertical product outlet opening formed in said third floor member to continue said drainage path from said air inlet opening through said secondary openings to said product outlet opening; and a primary wash deck apparatus mounted between said front wall and said central wall to be in flow communication with said main opening so that air from said air inlet will flow upwardly through said wash deck apparatus to separate said dirt and debris from said particulate material received on said wash deck apparatus, said primary wash deck apparatus being detachably mounted on said central wall.

11. The dedusting apparatus of claim 10 wherein said side walls include upper access doors corresponding to said upper area of said rear chamber, said first floor member having lateral portions sloped downwardly and outwardly to provide a drainage path from said air outlet opening to the respective said upper access doors.

12. The dedusting apparatus of claim 10 wherein said primary wash deck apparatus includes an upper segment having a wash deck formed thereon, and a lower segment detachable from said upper segment.

13. The dedusting apparatus of claim 12 wherein said central wall is formed with guide members for aligning said upper and lower segments when being mounted onto said central wall.

14. The dedusting apparatus of claim 10 wherein said front wall is removable from said housing to provide access into said front chamber and facilitate cleaning of said housing.

15. A dedusting apparatus for cleaning dirt and debris from particulate material, comprising:

a housing having laterally spaced side walls and vertically spaced top and bottom walls, said housing being divided into a front chamber and a rear chamber with a generally vertical transverse central wall therebetween extending between said side walls and between said top and bottom walls, said front chamber extending from a generally vertical front wall to said central wall, said rear chamber extending from said central wall to a generally vertical rear wall, said central wall being formed with a main opening and a pair of laterally spaced secondary openings located at a lower portion of said central wall, said rear chamber being divided into an upper area and a lower area, said upper area including a first floor member extending between said side walls and separating said upper and lower areas, said lower area including a second floor member extending between said side walls and said front chamber including a third floor member extending between said side walls, said upper area including an access door in each respective said side wall above said first floor member; and said housing being configured to drain liquid from all interior surfaces of said front and rear chambers out of said housing, including said second floor member having lateral outward portions being sloped downwardly and outwardly toward respective said secondary openings to provide a drainage path from said air inlet opening to said secondary openings, said third floor member being sloped downwardly and inwardly toward said product outlet opening to continue said drainage path from said air inlet opening through said secondary openings to said product outlet opening, said first floor being sloped downwardly and outwardly from a central portion to the respective said access doors in said side walls.

16. The dedusting apparatus of claim 15 further comprising:

a primary wash deck apparatus mounted between said front wall and said central wall to be in flow communication with said main opening in said central wall so that air from said air inlet will flow upwardly through said wash deck apparatus to separate said dirt and debris from said particulate material received on said wash deck apparatus, said primary wash deck apparatus being detachably mounted on said central wall.

17. The dedusting apparatus of claim 16 wherein said primary wash deck apparatus includes an upper segment having a wash deck formed thereon, and a lower segment detachable from said upper segment.

18. The dedusting apparatus of claim 17 wherein said central wall is formed with guide members for aligning said upper and lower segments when being mounted onto said central wall.

19. The dedusting apparatus of claim 18 wherein said front wall is removable from said housing to provide access into said front chamber and facilitate cleaning of said housing, said access doors being removable from said side walls to allow drainage of liquid from said first floor member out of said housing.

* * * * *